US010021937B2

(12) United States Patent
Sills

(10) Patent No.: US 10,021,937 B2
(45) **Date of Patent: *Jul. 17, 2018**

(54) ARTICLE OF FOOTWEAR WITH A CAVITY VIEWING SYSTEM

(71) Applicant: NIKE, Inc., Beaverton, OR (US)

(72) Inventor: Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 17 days.

This patent is subject to a terminal disclaimer.

(21) Appl. No.: 15/143,891

(22) Filed: May 2, 2016

(65) Prior Publication Data

US 2016/0242501 A1 Aug. 25, 2016

Related U.S. Application Data

(62) Division of application No. 14/663,999, filed on Mar. 20, 2015, now Pat. No. 9,351,535, which is a division (Continued)

(51) Int. Cl.

| | |
|---|---|
| ***A43B 13/14*** | (2006.01) |
| ***A43B 13/12*** | (2006.01) |
| ***A43B 1/00*** | (2006.01) |
| ***A43B 13/04*** | (2006.01) |
| ***A43B 13/16*** | (2006.01) |

(Continued)

(52) U.S. Cl.

CPC ..... *A43B 13/125* (2013.01); *A43B 1/0072* (2013.01); *A43B 7/24* (2013.01); *A43B 13/04* (2013.01); *A43B 13/14* (2013.01); *A43B 13/143* (2013.01); *A43B 13/146* (2013.01); *A43B 13/16* (2013.01); *A43B 13/181* (2013.01); *A43D 63/00* (2013.01)

(58) Field of Classification Search

CPC ..... A43B 13/14; A43B 13/146; A43B 1/0072; A43B 3/001

See application file for complete search history.

(56) References Cited

U.S. PATENT DOCUMENTS

| | | | |
|---|---|---|---|
| 4,817,304 | A | 4/1989 | Parker et al. |
| 5,220,737 | A | 6/1993 | Edington |

(Continued)

FOREIGN PATENT DOCUMENTS

| | | | |
|---|---|---|---|
| CN | 101163421 | A | 4/2008 |
| EP | 0456434 | A2 | 11/1991 |

(Continued)

OTHER PUBLICATIONS

Amended Claims for European National Stage Application No. 12745933.7 filed Nov. 28, 2013.

(Continued)

*Primary Examiner* — Ted Kavanaugh

(74) *Attorney, Agent, or Firm* — Honigman Miller Schwartz and Cohn LLP; Matthew H. Szalach; Jonathan P. O'Brien

(57) ABSTRACT

A sole structure for an article of footwear and a method of making the sole structure is disclosed. The sole structure can include an outsole and a midsole. The midsole includes a cavity with a protruding portion. A U-shaped or L-shaped transparent member is configured to cover the cavity so that the protruding portion remains visible from within the cavity.

20 Claims, 10 Drawing Sheets

Related U.S. Application Data of application No. 13/167,162, filed on Jun. 23, 2011, now Pat. No. 9,009,991.

(51) Int. Cl.

| | |
|---|---|
| ***A43D 63/00*** | (2006.01) |
| ***A43B 7/24*** | (2006.01) |
| ***A43B 13/18*** | (2006.01) |

(56) References Cited

U.S. PATENT DOCUMENTS

| | | | |
|---|---|---|---|
| 5,222,311 | A | 6/1993 | Lin |
| 5,224,280 | A | 7/1993 | Preman et al. |
| 5,490,338 | A | 2/1996 | Hwang I et al. |
| 5,542,195 | A | 8/1996 | Sessa |
| 5,822,885 | A | 10/1998 | Loverin |
| 6,012,822 | A | 1/2000 | Robinson |
| 6,055,747 | A | 5/2000 | Lombardino |
| 6,092,309 | A | 7/2000 | Edwards |
| 6,266,897 | B1 | 7/2001 | Seydel et al. |
| 6,516,540 | B2 | 2/2003 | Seydel et al. |
| 6,964,120 | B2 | 11/2005 | Cartier et al. |
| 7,100,309 | B2 | 9/2006 | Smith et al. |
| 7,353,625 | B2 | 4/2008 | Ellis et al. |
| 7,360,324 | B2 | 4/2008 | Aveni |
| 7,426,792 | B2 | 9/2008 | Swigart et al. |
| 9,009,991 | B2 | 4/2015 | Sills |
| 2002/0073579 | A1 | 6/2002 | Lombardino |
| 2006/0179683 | A1 | 8/2006 | Weiss et al. |
| 2007/0113425 | A1 | 5/2007 | Wakley et al. |
| 2008/0201982 | A1 | 8/2008 | Aveni et al. |
| 2008/0263894 | A1 | 10/2008 | Nakano |
| 2008/0295361 | A1* | 12/2008 | Johnson ..... A43B 1/0027 36/103 |

FOREIGN PATENT DOCUMENTS

| | | | |
|---|---|---|---|
| EP | 0500247 | A2 | 8/1992 |
| WO | 9115973 | A1 | 10/1991 |
| WO | 0065943 | A1 | 11/2000 |

OTHER PUBLICATIONS

Chinese Office Action dated Feb. 14, 2016 in Chinese Patent Application 201280030985.1.

Chinese Office Action dated Jun. 9, 2015 for Chinese Patent Application No. 201280030985.1.

English Translation of Detailed Observations for Office Action dated Jun. 9, 2015 for Chinese Patent Application No. 201280030985.1, 7 pages.

International Preliminary Report on Patentability for Application No. PCT/US2012/043659, dated Jan. 9, 2014.

International Search Report and Written Opinion for Application No. PCT/US2012/043659, dated Mar. 8, 2013.

Partial International Search Report for Application No. PCT/US2012/043659, dated Dec. 13, 2012.

Response to Office Action filed Oct. 26, 2016 in Chinese Patent Application No. 201280030985.1, 7 pages.

European Patent Office, Communication pursuant to Article 94(3) EPC for Application EP12745933.7, dated Nov. 30, 2016.

* cited by examiner

ARTICLE OF FOOTWEAR WITH A CAVITY VIEWING SYSTEM

CROSS REFERENCE TO RELATED APPLICATIONS

This non-provisional U.S. Patent Application is a divisional of and claims priority under 35 U.S.C. 121 to U.S. application Ser. No. 13/167,162 entitled "Article Of Footwear With A Cavity Viewing System," filed on Jun. 23, 2011, which published as U.S. Patent Application Publication Number US 2012/0324761 on Dec. 27, 2012 and was issued on Apr. 21, 2015 as U.S. Pat. No. 9,009,991, and U.S. application Ser. No. 14/663,999 entitled "Article Of Footwear With A Cavity Viewing System," filed on Mar. 20, 2015, which published as U.S. Patent Application Publication Number US 2015/0250261 on Sep. 10, 2015 and was allowed on Feb. 1, 2016, the disclosures of which applications are hereby incorporated by reference in their entirety.

BACKGROUND

The present invention relates generally to an article of footwear, and in particular to an article of footwear with a cavity viewing system.

Nakano (U.S. patent application publication number 2008/0263894 A1) teaches a footwear sole that includes a shock absorbing device having an upper plate, a lower plate and a plurality of shock absorbing elements that extend from the plates. The lower plate includes an upper surface, a peripheral edge and a peripheral wall that extends upwardly from the peripheral edge to form a shell. The peripheral wall may be integrally formed with the lower plate and both may be molded from plastic, such as TPU, and formed from a transparent material. The plates and the wall of the device are positioned between the upper and the outsole of the shoe and are retained in the heel region of a top surface of the outsole between an upwardly extending rear wall and a front wall. The surface may alternatively include a midsole or other component between the upper and the outsole. When the device is positioned in the heel region of the outsole, the shock absorbing elements are visible through the peripheral wall and/or the lower plate. Likewise, the plate is exposed, in part, through a cutout portion disposed in the heel region of the outsole.

Wakley (U.S. patent application publication 2007/0113425 A1) teaches a midsole for footwear that includes solid or hollow cushioning tubes. Each tube is the exact width of the midsole so that the tubes are visible from the exterior of the shoe on both of its sides. Both a lower midsole portion and an upper midsole portion have cavities molded in the exact shape of the tubes. The tubes can be open ended at the edge of the midsole or may be enclosed inside a transparent material.

Weiss (U.S. patent application publication 2006/0179683) teaches a pair of inserts for footwear that may be inserted into any portion of the sole but which are preferably inserted into a heel portion. The inserts each have a compressible core and a transparent and flexible casing for surrounding at least a portion of the cores. The cores may include decorative patterns or ribs which are visible through the transparent casing. A portion of the inserts are exposed at any surface, including the bottom, sides and rear of the shoe so that they may be touched. Moreover, the decorative core is visible through the transparent casing from the exterior of the shoe wherever the insert is exposed. The pair of inserts may alternatively be a single larger insert.

The related art lack provisions for providing a low cost alternative to the shock absorbing devices used in a shoe. There is a need for articles that address the limitations of the related art.

SUMMARY

In one aspect, the invention provides an article of footwear, comprising: a sole structure including a lower portion, a lateral portion and a medial portion; the sole structure including a cavity, the cavity further comprising a medial opening disposed on the medial portion, a lateral opening disposed on the lateral portion and a lower opening disposed on the lower portion; a transparent member, the transparent member being approximately U-shaped; and where the transparent member corresponds to the cavity and wherein the transparent member is configured to cover the lateral opening, the medial opening and the lower opening.

In one aspect, the invention provides an article of footwear, comprising: a sole structure including a lower portion, a lateral portion and a medial portion; the sole structure including a cavity, the cavity having an upper surface; the cavity further comprising a medial opening disposed on the medial portion, a lateral opening disposed on the lateral portion and a lower opening disposed on the lower portion; a transparent member, the transparent member being substantially U-shaped; the transparent member being configured to cover the lateral opening, the medial opening and the lower opening; the sole structure including a protruding portion that extends from the upper surface into the cavity; and where an end of the protruding portion contacts the transparent member.

In one aspect, the invention provides a method of making an article of footwear, comprising: forming a sole structure by forming a cavity on a lower portion, the cavity being open on the lower portion, a lateral portion and a medial portion of the sole structure; attaching a bent transparent member to the sole structure, the bent transparent member comprising a first end portion, a second end portion and an intermediate portion and wherein the first end portion is bent with respect to the intermediate portion and wherein the second end portion is bent with respect to the intermediate portion; covering a lateral opening of the cavity disposed on the lateral portion with the first end portion;

covering a medial opening of the cavity disposed on the medial portion with the second end portion; covering a lower opening of the cavity disposed on the lower portion with the intermediate portion; and where the cavity can be viewed through the bent transparent member.

In one aspect, the present disclosure is directed to an article of footwear. The article of footwear may include a sole structure including a lower portion, a lateral portion and a medial portion. The sole structure may further include a cavity, wherein the cavity includes a medial opening disposed on the medial portion, a lateral opening disposed on the lateral portion and a lower opening disposed on the lower portion. In addition, the article of footwear may include a first transparent member, the transparent member being approximately L-shaped. Also, the first transparent member may correspond to the cavity and the first transparent member may be configured to cover the lateral opening and extend medially along a bottom portion of the cavity or cover the medial opening and extend laterally along a bottom portion of the cavity.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
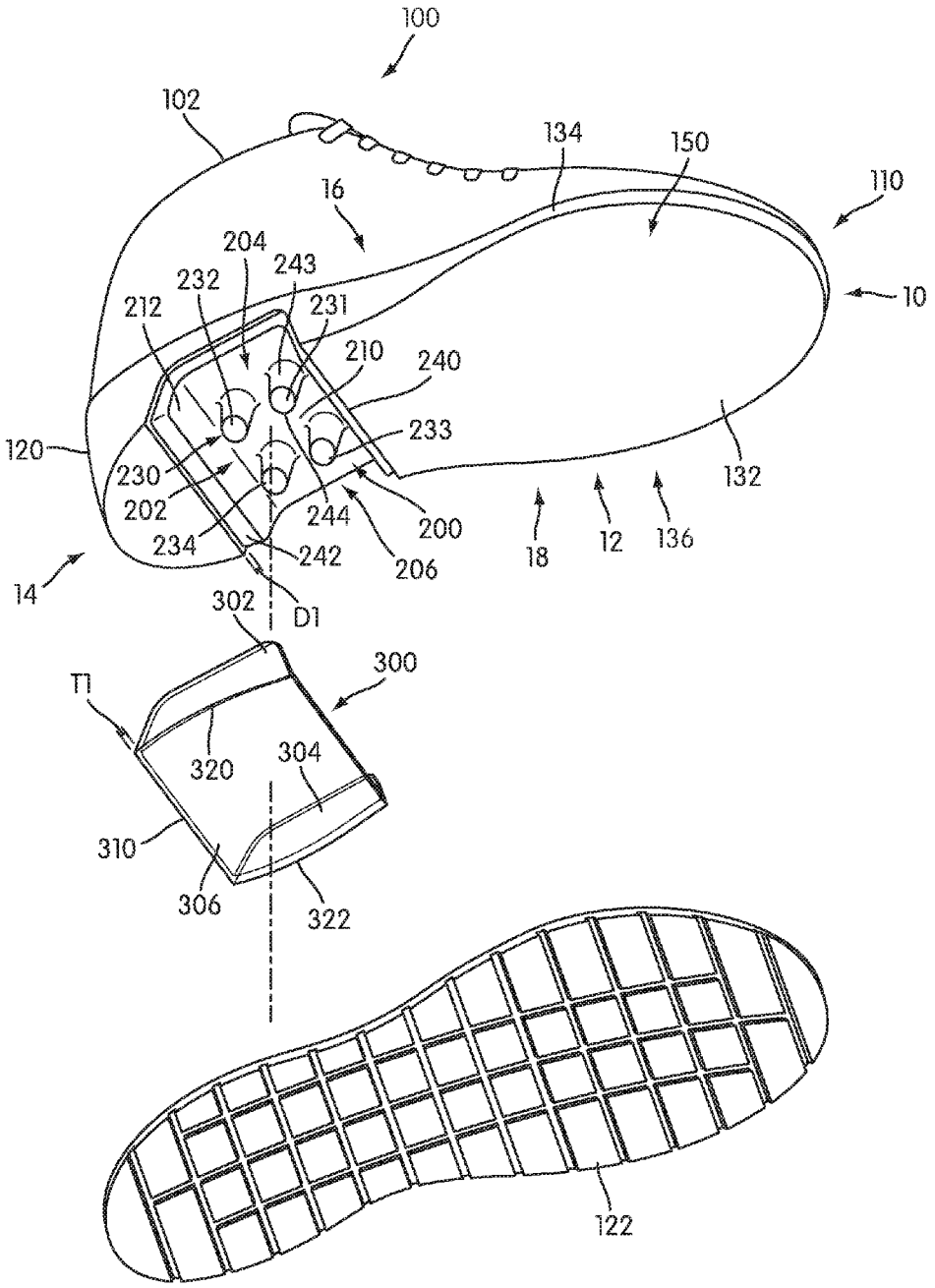
FIG. 1 is an exploded isometric view of an embodiment of an article of footwear.
Figure 2:
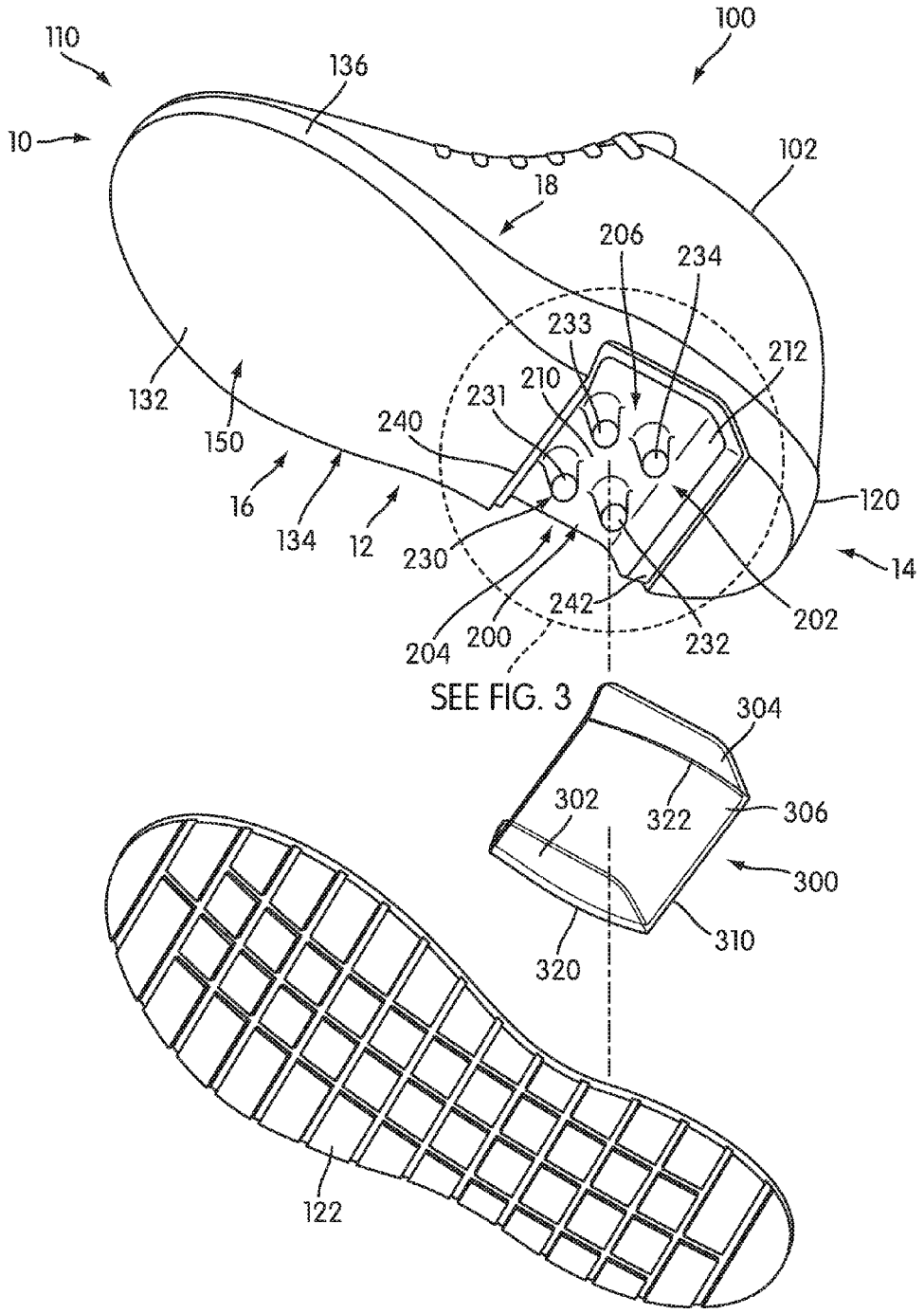
FIG. 2 is an enlarged isometric view of an embodiment of a portion of an article of footwear.
Figure 3:
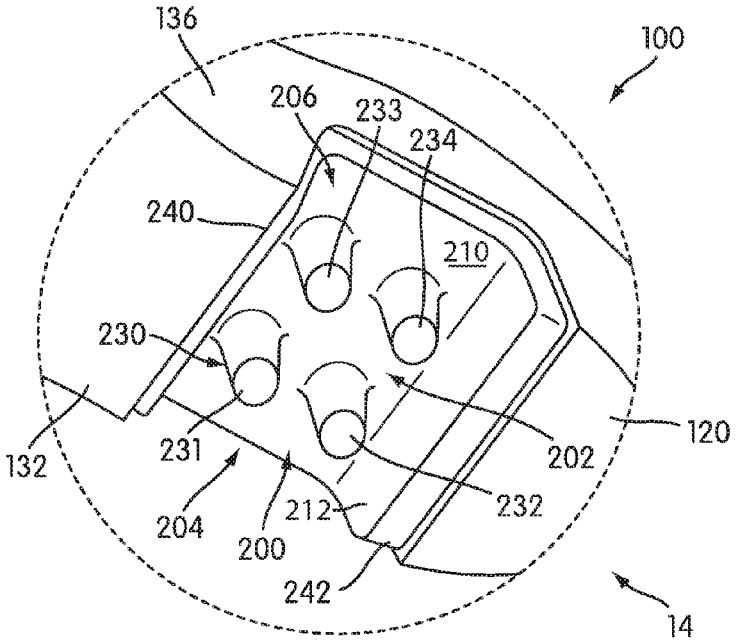
FIG. 3 is an enlarged isometric view of an embodiment of a portion of an article of footwear.
Figure 4:
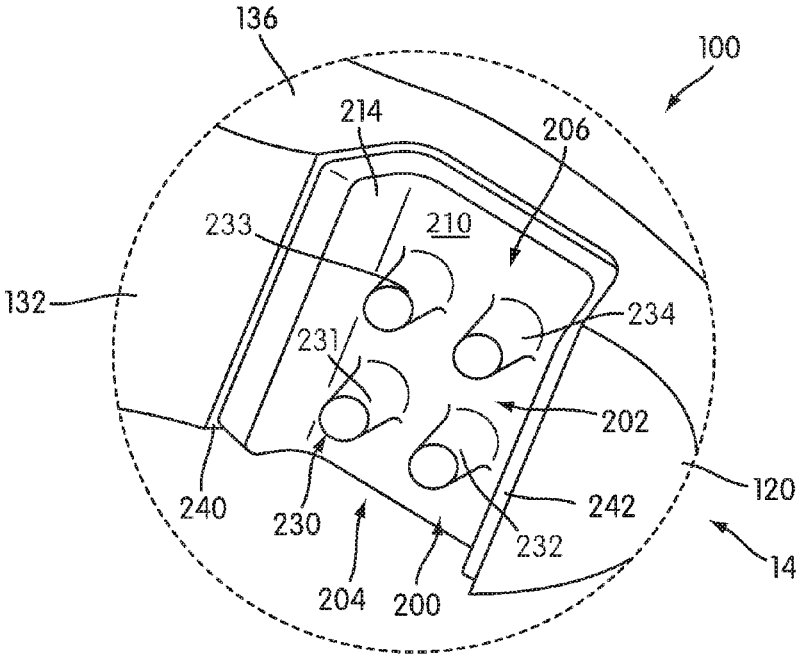
FIG. 4 is an isometric exploded view of an embodiment of an article of footwear.
Figure 5:
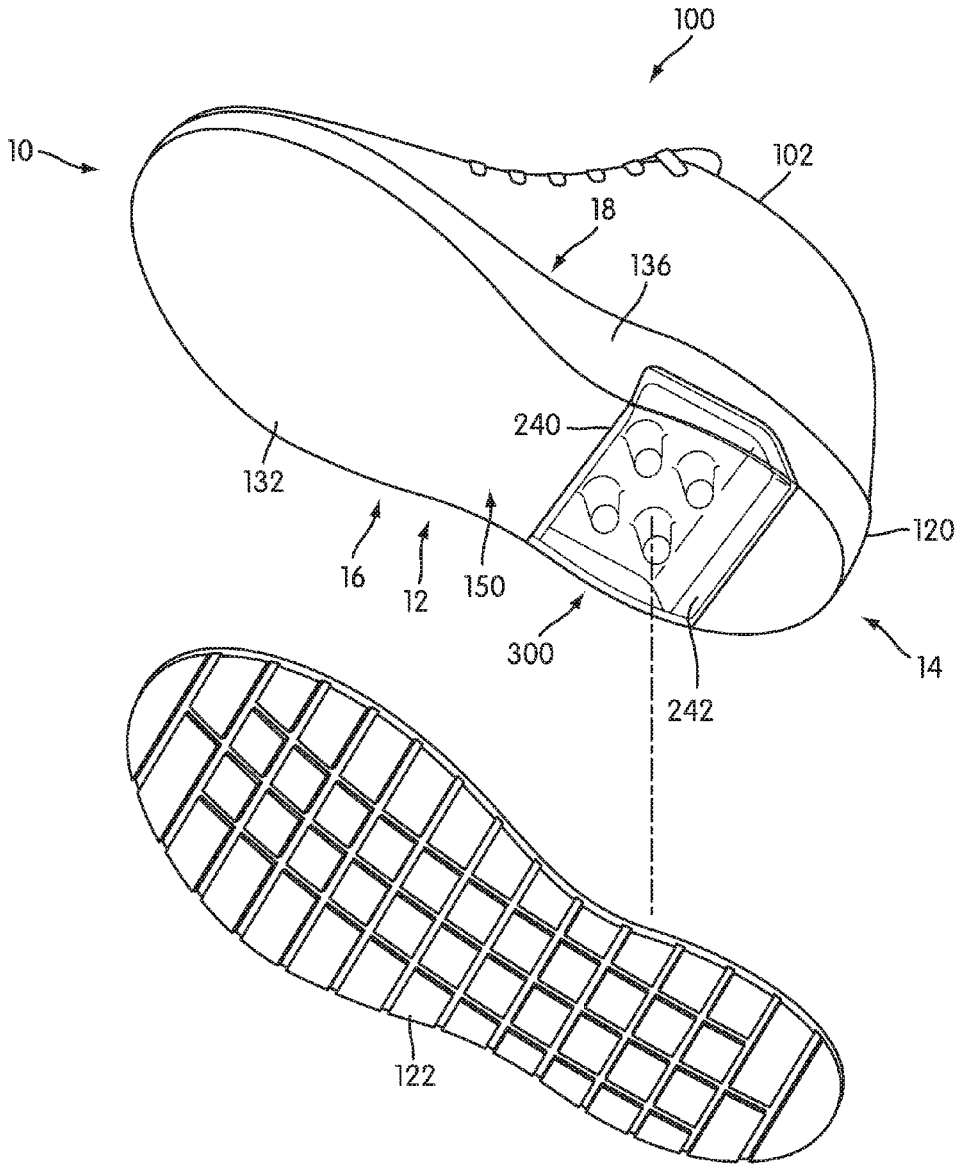
FIG. 5 is an isometric view of an embodiment of an article of footwear.
Figure 6:
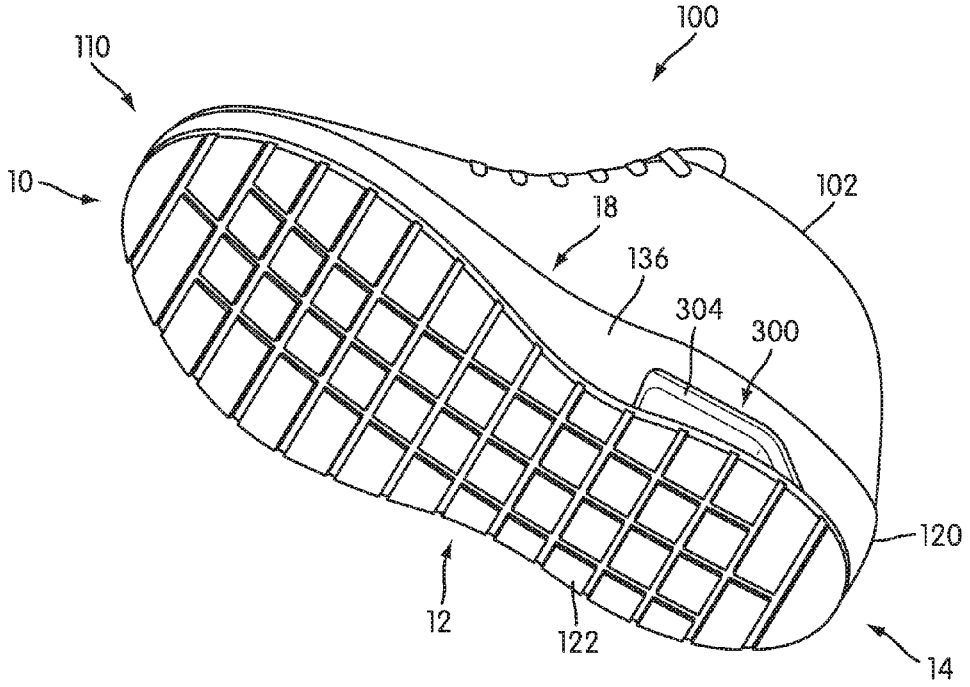
FIG. 6 is an isometric view of an embodiment of an article of footwear.
Figure 7:
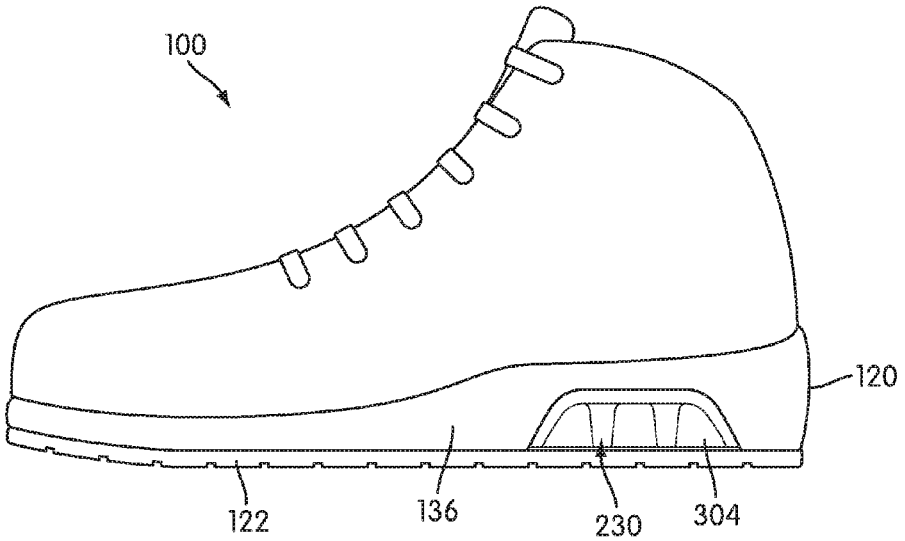
FIG. 7 is a side view of an embodiment of an article of footwear.
Figure 8:
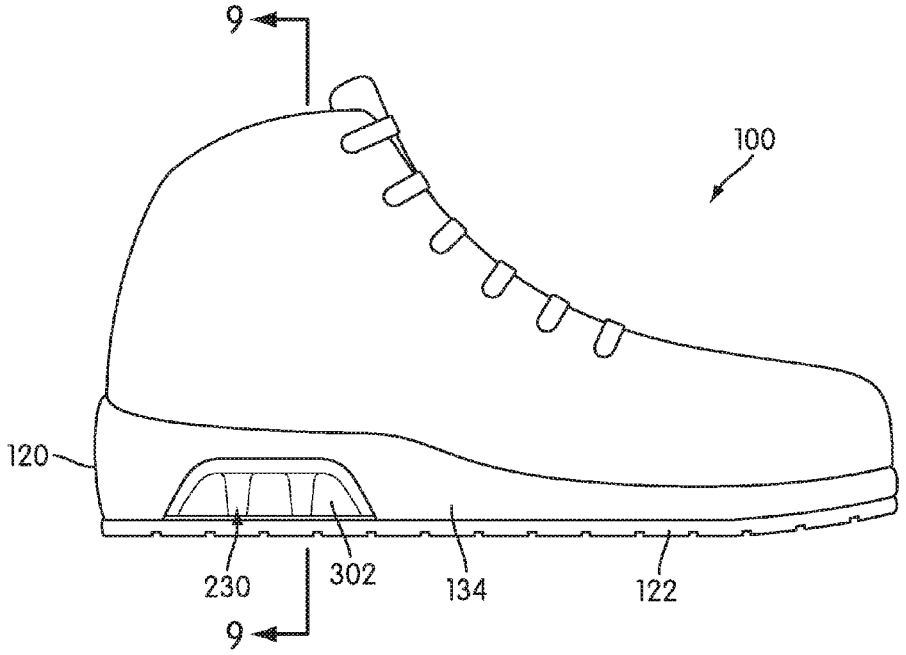
FIG. 8 is a side view of an embodiment of an article of footwear.

FIGS. 1 through 9 illustrate views of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 through 9, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 6, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 can include midsole 120 and outsole 122.

Midsole 120 can comprise lower portion 132, lateral portion 134 and medial portion 136. In some cases, lower portion 132 may be associated with outsole 122. In other cases, lower portion 132 may be configured to contact a ground surface. In addition, in some cases, lateral portion 134 and medial portion 136 may be associated with lateral and medial sidewalls, respectively, of midsole 120.

Midsole 120 can include cavity 200. In different embodiments, cavity 200 can be disposed on different portions of midsole 120. In some cases, cavity 200 can be disposed on forefoot portion 10 of midsole 120. In other cases, cavity 200 can be disposed on midfoot portion 12 of midsole 120. In still other cases, cavity 200 can be disposed on heel portion 14 of midsole 120. In still other cases, cavity 200 can be disposed on any combination of forefoot portion 10, midfoot portion 12 and heel portion 14. In an exemplary embodiment, cavity 200 may be disposed on heel portion 14.

Cavity 200 can be associated with one or more portions of midsole 120. In some cases, cavity 200 can be associated with lower portion 132. In other cases, cavity 200 can be associated with medial portion 136. In still other cases, cavity 200 can be associated with lateral portion 134. In an exemplary embodiment, cavity 200 can be associated with lower portion 132, lateral portion 134 and medial portion 136.

Cavity 200 can include various openings associated with different portions of midsole 120. In this embodiment, cavity 200 may include lower opening 202 that is disposed on lower portion 132. In addition, cavity 200 may include lateral opening 204 that is disposed on lateral portion 134. Also, cavity 200 may include medial opening 206 that is disposed on medial portion 136. In other words, cavity 200 may be open on lower portion 132, lateral portion 134 and medial portion 136 of midsole 120. With this arrangement, lower opening 202, lateral opening 204 and medial opening 206 can be configured as an approximately U-shaped opening that wraps around midsole 120 from lateral portion 134, across lower portion 132, to medial portion 136. In other embodiments, lower opening 202, lateral opening 204 and medial opening 206 could be configured in any other shape.

Cavity 200 may comprise upper surface 210, first sidewall surface 212 and second sidewall surface 214. Upper surface 210 may be recessed from lower portion 132. Also, in some cases, upper surface 210 may be approximately parallel with lower portion 132. In other cases, however, upper surface 210 may be angled with respect to lower portion 132.

First sidewall surface 212 and second sidewall surface 214 may extend between upper surface 210 and lower portion 132. In particular, first sidewall surface 212 and second sidewall surface 214 (see FIG. 4) may be angled with respect to upper surface 210. In addition, in some embodiments, first sidewall surface 212 and second sidewall surface 214 may be angled with respect to lower portion 132.

In some embodiments, first sidewall surface 212 may be oriented to face in the longitudinal direction. Likewise, in some embodiments, second sidewall surface 214 may be oriented to face in the longitudinal direction. In other embodiments, however, first sidewall surface 212 can be oriented in any other direction. Likewise, in other embodiments, second sidewall surface 214 can be oriented in any other direction.

In different embodiments, the arrangement of upper surface 210, first sidewall surface 212 and second sidewall surface 214 can vary. For example, in one embodiment, upper surface 210, first sidewall surface 212 and second sidewall surface 214 can have an arch-like shape. In other embodiments, upper surface 210, first sidewall surface 212 and second sidewall surface 214 can be approximately U-shaped. In addition, it will be understood that in different embodiments, the angle between first sidewall surface 212 and upper surface 210 can vary between 0 and 180 degrees. In a similar manner, the angle between second sidewall surface 214 and upper surface 210 can vary between 0 and 180 degrees.

By varying the arrangement of upper surface 210, first sidewall surface 212 and second sidewall surface 214, the shapes and sizes of various openings of cavity 200 can vary. In the exemplary embodiment, lower opening 202 may have an approximately rectangular shape. In addition, lateral opening 204 and medial opening 206 may both have approximately trapezoidal shapes. However, in other embodiments, lower opening 202, lateral opening 204 and medial opening 206 may have any shapes including, but not limited to: rounded shapes, rectangular shapes, polygonal shapes, regular shapes, irregular shapes, as well as any other types of shapes.

Cavity 200 can include first peripheral portion 240. First peripheral portion 240 may be associated with the edges of upper surface 210, first sidewall surface 212 and second sidewall surface 214. In addition, in some cases, first peripheral portion 240 may be further associated with lowered peripheral ledge 242 that extends around a majority of first peripheral portion 240.

In different embodiments, the depth of lowered peripheral ledge 242 with respect to lower portion 132 can vary. In this embodiment, lowered peripheral ledge 242 can have depth D1 with respect to lower portion 132, as illustrated in FIG. 1. In some cases, depth D1 may have a value in the range between 0.001 millimeters and 1 centimeter. In other cases, depth D1 can have any other value.

An article of footwear can include provisions for reducing manufacturing costs. In some embodiments, an article of footwear with a cavity can be configured to give the appearance of a shoe that includes various energy return systems. In an exemplary embodiment, an article of footwear can include portions that resemble structural features of an energy return system.

In some embodiments, cavity 200 can be associated with one or more protruding portions. The term "protruding portion" as used throughout this detailed description and in the claims refers to any portions that extend outwards from one or more surfaces of a cavity. For example, in one embodiment, cavity 200 can include protruding portion set 230. Generally, protruding portion set 230 can include any number of protruding portions. In some cases, protruding portion set 230 can include a single protruding portion. In other cases, protruding portion set 230 can include two or more protruding portions. In this embodiment, protruding portion set 230 may include four protruding portions. In particular, protruding portion set 230 may comprise first protruding portion 231, second protruding portion 232, third protruding portion 233 and fourth protruding portion 234.

In different embodiments, the geometry of one or more protruding portions can vary. In one embodiment, first protruding portion 231 may have a truncated conical shape. In particular, first protruding portion 231 can have a generally circular cross-sectional shape that varies in diameter between first end 243 and second end 244, as seen in FIG. 1. For example, the cross sectional diameter of first end 243 may be larger than the cross sectional diameter of second end 244. In a similar manner, in some embodiments, the shapes of second protruding portion 232, third protruding portion 233 and fourth protruding portion 234 can be substantially similar to first protruding portion 231.

Although the current embodiment includes protruding portions with substantially circular cross sectional shapes, in other embodiments, the cross sectional shapes of one or more protruding portions of protruding portion set 230 can be different. Examples of different cross sectional shapes that may be used include, but are not limited to: rectangular shapes, triangular shapes, oval shapes, polygonal shapes, irregular shapes as well as any other kinds of shapes. Still further, in other embodiments the cross sectional diameter can vary, as in the current embodiment, or remain substantially constant. For example, in another embodiment, one or more protruding portions of protruding portion set 230 can have substantially cylindrical shapes. In particular, each protruding portion can have an approximately circular cross sectional shape with a diameter that remains substantially constant over the vertical height of the protruding portion.

In other embodiments, the shapes of one or more protruding portions can be similar to the shapes of one or more structural members that may be associated with various types of footwear. For example, in one embodiment, the shapes of one or more protruding portions can be similar to support columns that can be used for providing shock absorption and/or cushioning effects in an article of footwear. Examples of such support columns can be found in U.S. Pat. No. 6,964,120, the entirety of which is hereby incorporated by reference. In addition, in some embodiments, the geometry of one or more protruding portions can be varied to incorporate ribs, holes, smooth surfaces, indentations as well as other features disclosed in U.S. Pat. No. 7,100,309, the entirety of which is hereby incorporated by reference.

In different embodiments, one or more protruding portions of protruding portion set 230 can be associated with various surfaces of cavity 200. In some cases, protruding portion set 230 can include protruding portions that extend from upper surface 210. In other cases, protruding portion set 230 can include protruding portions that extend from first sidewall surface 212. In other cases, protruding portion set 230 can include protruding portions that extend from second sidewall surface 214. In an exemplary embodiment, first protruding portion 231, second protruding portion 232, third protruding portion 233 and fourth protruding portion 234 may extend from upper surface 210 in a generally vertical direction. In other words, first protruding portion 231, second protruding portion 232, third protruding portion 233 and fourth protruding portion 234 may each extend between upper surface 210 and lower portion 132.

A sole structure including a cavity with protruding portions can include provisions for covering one or more openings of the cavity. In some embodiments, the sole structure can include provisions for covering the cavity in a manner that allows the protruding portions to be viewed from outside of the cavity. In an exemplary embodiment, a sole structure can be associated with a transparent member that is configured to cover one or more openings of a cavity in a manner that keeps the protruding portions visible from outside the cavity.

Sole structure 110 can be associated with transparent member 300. Generally, transparent member 300 may be formed from any generally two-dimensional material. The term "two-dimensional material" as used through this detailed description and in the claims refers to any generally flat material exhibiting a length and width that are substantially greater than a thickness of the material. Examples of different materials that could be used for transparent member 300 include, but are not limited to: textiles, polymer sheets or combinations of textiles and polymer sheets. In embodiments where textiles are used, the textiles should be made of a substantially transparent material or have a mesh size that provides for substantial transparency. In embodiments where polymer sheets are used, the polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for transparent member 300. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness.

In some embodiments, transparent member 300 may be formed from a substantially transparent polymer sheet or layer. In one exemplary embodiment, transparent member 300 may be made of a thermoplastic polymer material. In one embodiment, transparent member 300 may comprise a layer of thermoplastic urethane (TPU).

Although transparent member 300 is formed from a generally two-dimensional material, transparent member 300 may be configured with some thickness. For example, in one embodiment, transparent member 300 can be associated with thickness T1, as seen in FIG. 1. In some cases, thickness T1 can have a value in the range between 0.001 millimeters and 1 centimeter. In other cases, thickness T1 can have any other value. Additionally, it will be understood that the height and width of transparent member 300 can be selected according to the size of cavity 200 and that the height and width may have values that are substantially larger than the value of thickness T1.

Transparent member 300 may comprise first end portion 302 and second end portion 304. In addition, transparent member 300 may comprise intermediate portion 306 that is disposed between first end portion 302 and second end portion 304. Furthermore, transparent member 300 may be associated with second peripheral portion 310 that extends around the edges of first end portion 302, second end portion 304 and intermediate portion 306.

In different embodiments, the geometry of transparent member 300 can vary. In some cases, transparent member 300 may be a bent transparent member. In other words, transparent member 300 can include first bend 320 disposed between first end portion 302 and intermediate portion 306. In other words, first end portion 302 may be angled with respect to intermediate portion 306. In addition, transparent member 300 can include second bend 322 disposed between second end portion 304 and intermediate portion 306. In other words, second end portion 304 may be angled with respect to intermediate portion 306. With this arrangement, transparent member 300 may be configured with U shape.

In different embodiments, the angle between first end portion 302 and intermediate portion 306 can vary. In some cases, the angle can have a value in the range between 0 and 180 degrees. In other cases, the angle can have a value in the range between 45 and 135 degrees. Likewise, the angle between second end portion 304 and intermediate portion 306 can vary. In some cases, the angle can have a value in the range between 0 and 180 degrees. In other cases, the angle can have a value in the range between 45 and 135 degrees.

Figure 9:
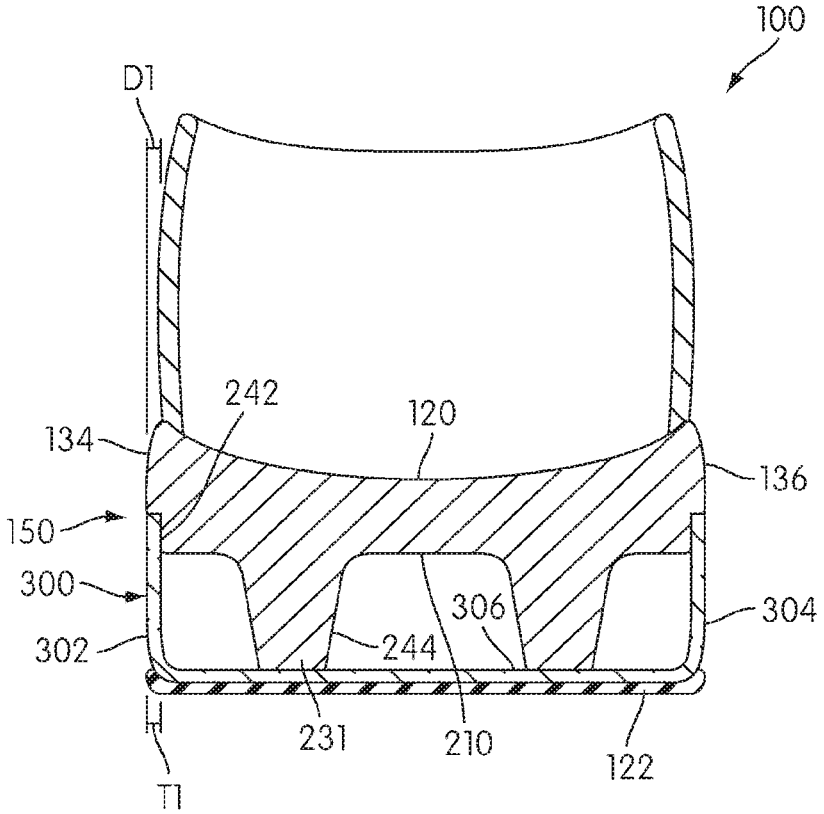
FIG. 9 is a cross sectional view of an embodiment of an article of footwear.

Transparent member 300 can be configured to cover cavity 200. In some embodiments, first end portion 302 may be configured to cover lateral opening 204. Also, second end portion 304 may be configured to cover medial opening 206. In addition, intermediate portion 306 may be configured to cover lower opening 202. With this arrangement, transparent member 300 may cover a substantial entirety of cavity 200. For example, as shown in FIG. 9, which is a cross sectional view of article of footwear 100, transparent member 300 may be configured to cover lateral opening 204, medial opening 206, and lower opening 202.

In other embodiments, a transparent member may be configured to cover only a portion of a cavity. For example, transparent members may be configured to cover a medial opening and a lateral opening, but not a lower opening. In some embodiments, either a medial opening or a lateral opening may be covered, rather than both. For example, it may be desirable to include a transparent member only on a lateral side of an article of footwear. An exemplary situation in which this may be desirable could be for an article of footwear that is anticipated to be used in harsh environments. In such a case, it may not be desirable to include a transparent member on a medial or lower side, as it could be subjected to much higher levels of abuse than a lateral side of the article of footwear. Such abuse could leave significant markings on a transparent member, which may not be desirable. Different activities may be harsher on other portions of the article of footwear and, therefore, other configurations for transparent members may be implemented in view of the environment and activity for which the article of footwear will be used.

In addition, it may be desirable to include only one transparent member (e.g., lateral or medial) based on anticipated stresses the shoe will be likely to undergo during use. In some embodiments, the placement of a lateral transparent member that wraps around a lower lateral edge of a sole structure, may provide increased stability to the lateral side of the article of footwear. This may be applicable, for example, to reduce the likelihood of sprained ankles. Similarly, it may be desirable to implement a transparent member on a medial side to provide additional support, for example, to reduce the likelihood of pronation. For such embodiments where lateral and/or medial transparent members are implemented as a stabilizing element, materials may be selected for the transparent members that are suitable for such applications. For example, such suitable materials may be resistant to stretching and/or other modes of deformation.

Figure 9A:
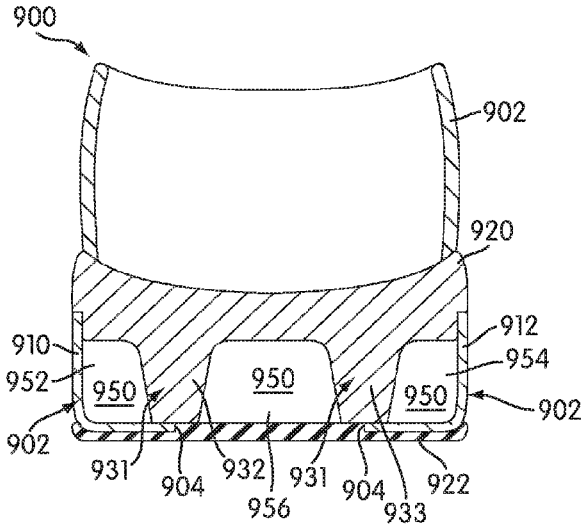
FIG. 9A is a cross sectional view of an embodiment of an article of footwear.
Figure 9B:
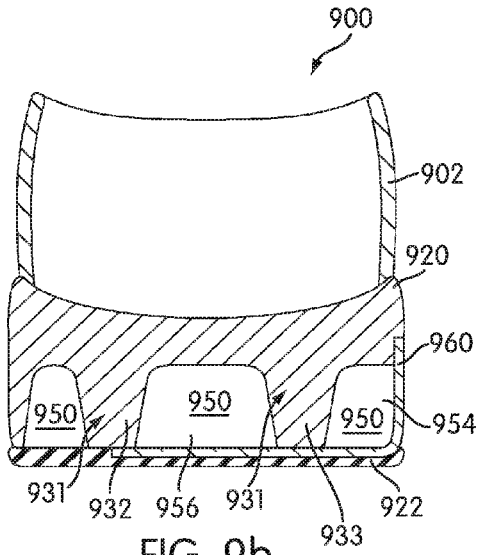
FIG. 9B is a cross sectional view of an embodiment of an article of footwear.
Figure 9C:
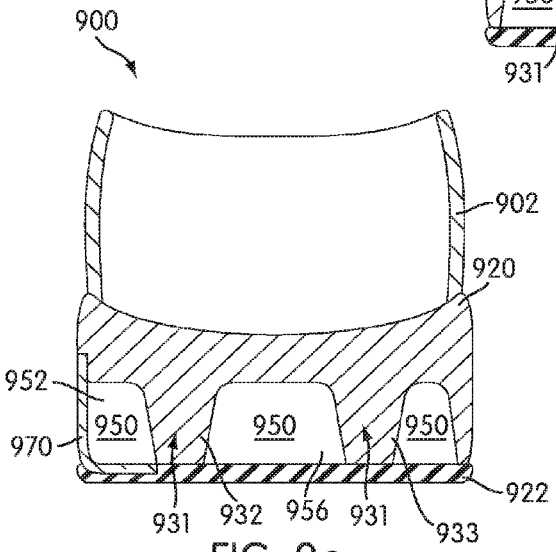
FIG. 9C is a cross sectional view of an embodiment of an article of footwear.

FIGS. 9A-9C illustrate alternative embodiments having transparent members that cover various portions of a cavity. For example, FIG. 9A shows a schematic cross-sectional view of an exemplary article of footwear 900. Article of footwear 900 may include many of the same or similar components as article of footwear 100. For example, article 900 may include an upper 902, a midsole 920, and an outsole 922. Article 900 may also include a cavity 950 defined by midsole 920. For example, midsole 920 may at least partially define an upper surface of cavity 950. In some embodiments, cavity 950 may include a lateral opening 952, a medial opening 954, and a lower opening 956. Within cavity 950, may be disposed elements of an energy return system (or elements having the appearance of an energy return system). For example, one or more protruding portions 931 may be disposed within cavity 950. Although article 900 may include any suitable number of protruding portions 931, FIGS. 9A-9C only show a lateral protruding portion 932 and a medial protruding portion 933. These elements may have properties and configurations that are the same or substantially similar to corresponding components of article 100.

As further shown in FIG. 9A, article 900 may include dual transparent members 902. For example, article 900 may include a lateral transparent member 910 and a medial transparent member 912. In some embodiments, one or both of transparent members 902 may be approximately L-shaped, for example as shown in FIG. 9A. Transparent members 902 may be configured to at least partially enclose cavity 950 by covering lateral opening 952 and medial opening 954, as shown in FIG. 9A. As further shown in FIG. 9A, lower opening 956 may be covered by outsole 922, and thus, in some embodiments, cavity 950 of article 900 may not be visible from below article 900. Transparent members 902 may wrap around lower lateral and lower medial portions of cavity 950, and extend partially inward (i.e., laterally or medially), along a bottom portion of cavity 950, toward a centerline of article 900. For example, transparent members 902 may be disposed at least partially between outsole 922 and cavity 950. In some embodiments, inner end portions 904 of transparent members 902 may extend inwardly to a central part of protruding portions 931, as shown in FIG. 9A. In other embodiments, inner end portions 904 may extend more inward or less inward.

Outsole 922 may be associated with the lower portion of cavity 950. In some embodiments, outsole 922 may include an aperture (see, e.g., FIG. 10). In some embodiments, the aperture may be disposed on at least one of transparent members 902. Accordingly, in such embodiments, the interior of cavity 950 may be visible through the aperture in outsole 922.

In some embodiments, ends of protruding portions 931 may contact either or both of transparent members 902. For example, in some embodiments, the end of the protruding portion 931 may extend to lower opening 956, as shown in FIG. 9A. Therefore, in some embodiments, protruding portions 931 can be viewed through either or both of transparent members 902. For example, protruding portions 931 may be viewed through lateral opening 952, medial opening 954, and/or lower opening 956.

As shown in FIG. 9B, in some embodiments, article 900 may be provided with a transparent member on a medial side of article 900 but not a lateral side. For example, a medial transparent member 960 may at least partially enclose cavity 950 by covering medial opening 954. In some embodiments, medial transparent member 960 may be approximately L-shaped, for example as shown in FIG. 9B. In some embodiments, medial transparent member 960 may extend laterally, along the bottom portion of cavity 950, far enough to cover all or part of lower opening 956, as shown in FIG. 9B.

Figure 10:
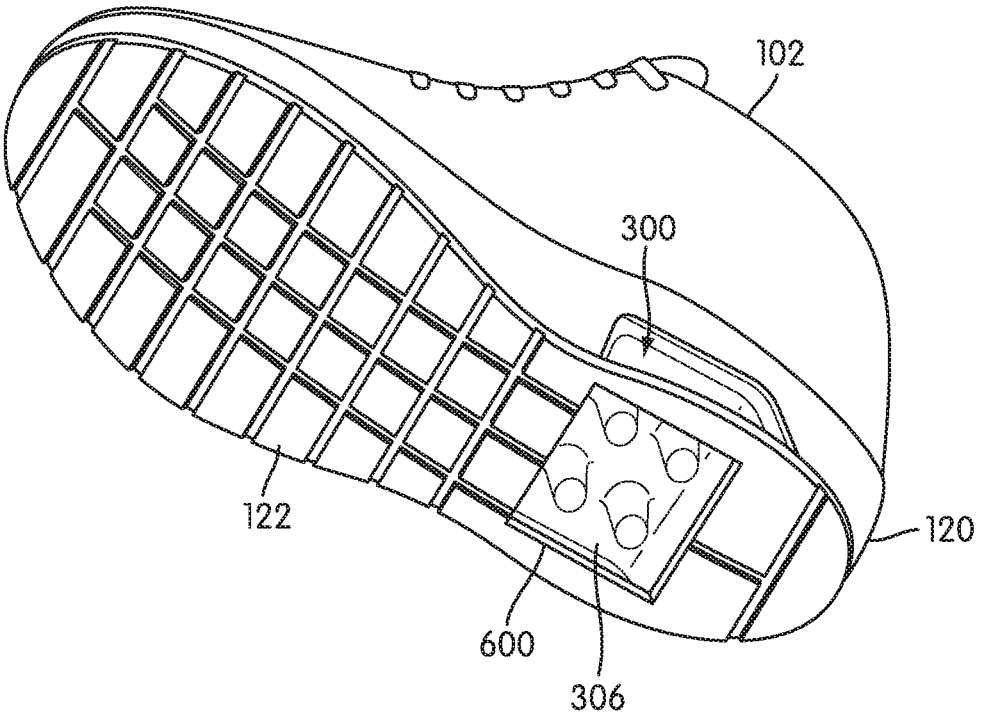
FIG. 10 is an isometric view of an embodiment of an article of footwear.

As in other embodiments, outsole 922 may include an aperture (see, e.g., FIG. 10). In some embodiments, the aperture may be disposed on medial transparent member 960. Accordingly, in such embodiments, the interior of cavity 950 may be visible through the aperture in outsole 922.

In some embodiments, ends of protruding portions 931 may contact medial transparent member 960. For example, in some embodiments, the end of the protruding portion 931 may extend to lower opening 956, as shown in FIG. 9B. Therefore, in some embodiments, protruding portions 931 can be viewed through medial transparent member 960. For example, protruding portions 931 may be viewed through lateral opening 952, medial opening 954, and/or lower opening 956.

As shown in FIG. 9C, in some embodiments, article 900 may be provided with a transparent member on only a lateral side of article 900, but not a medial side. For example, a lateral transparent member 970 may at least partially enclose cavity 950 by covering lateral opening 952. In some embodiments, medial transparent member 960 may be approximately L-shaped, for example as shown in FIG. 9C. In some embodiments, lateral transparent member 970 may extend medially, along the bottom portion of cavity 950, far enough to cover all or part of lower opening 956. In other embodiments, lateral transparent member 970 may not extend as far medially, as shown in FIG. 9B.

As in other embodiments, outsole 922 may include an aperture (see, e.g., FIG. 10). In some embodiments, the aperture may be disposed on lateral transparent member 970. Accordingly, in such embodiments, the interior of cavity 950 may be visible through the aperture in outsole 922.

In some embodiments, ends of protruding portions 931 may contact lateral transparent member 970. In some embodiments, the end of the protruding portion 931 may extend to lower opening 956, as shown in FIG. 9C. Therefore, in some embodiments, protruding portions 931 can be viewed through lateral transparent member 970. For example, protruding portions 931 may be viewed through lateral opening 952, medial opening 954, and/or lower opening 956.

As discussed above with respect to transparent members 902, lateral transparent member 970 may extend medially any suitable distance. Therefore, lateral transparent member 970 may or may not be contacted by protruding portions 931. Further, the aperture in outsole 922 may or may not be disposed on lateral transparent member 970.

It should be noted that any of the configurations discussed with respect to FIGS. 9A-9C may be combined in any suitable way. For example, medial transparent member 960 could be employed in the same embodiment as lateral transparent member 970. If medial transparent member 960 and lateral transparent member 970 are configured as shown in FIGS. 9B and 9C, combining these two transparent members would leave only a small gap between the lower portion of these transparent members. Such a configuration is among many envisaged combinations. Those having ordinary skill in the art will recognize suitable configurations and combinations of the disclosed transparent members.

A midsole can include provisions for receiving a transparent member in a manner that provides for a generally smooth outer surface on the sole structure. In some embodiments, a ledge of a peripheral portion can be shaped to receive a peripheral portion of a transparent member. In an exemplary embodiment, a ledge may be configured with a depth that is substantially similar to the thickness of the transparent member in order to provide a generally flush arrangement on an outer surface of the midsole. In other embodiments, however, a midsole may not include a ledge and instead a transparent member may have a tapered peripheral portion.

In this embodiment, midsole 120 can include provisions for receiving transparent member 300. In some embodiments, lowered peripheral ledge 242 may be shaped to receive second peripheral portion 310 of transparent member 300. In some cases, lowered peripheral ledge 242 may be configured to receive transparent member 300 in a manner so that transparent member 300 is substantially flush with lower portion 132, lateral portion 134 and medial portion 136. For example, in one embodiment, depth D1 of lowered peripheral ledge 242 may be substantially similar to thickness T1 of second peripheral portion 310. This arrangement can be seen in FIG. 9, which is a cross sectional view of article of footwear 100. With this arrangement, transparent member 300 may be substantially flush with an outer surface 150 of midsole 120. In other embodiments, depth D1 could be substantially larger than thickness T1 so that transparent member 300 is recessed with respect to outer surface 150. In still other embodiments, depth D1 could be substantially less than thickness T1 so that transparent member 300 is raised with respect to outer surface 150 of midsole 120.

As discussed above, in different embodiments, depth D1 of lowered peripheral ledge 242 can vary. In some cases, the value of depth D1 can be selected according to the thickness of transparent member 300. For example, in one embodiment, if the value of thickness T1 of second peripheral portion 310 of transparent member 300 is known, the value of depth D1 can be selected to accommodate thickness T1. In other cases, wherein the value of depth D1 is known, the value of thickness T1 can be selected to accommodate the value of depth D1.

Referring to FIGS. 6 through 9, in some embodiments, outsole 122 may be configured to cover lower portion 132 of midsole 120. Furthermore, heel portion 14 of outsole 122 may cover a portion of transparent member 300. In particular, outsole 122 may be configured to cover intermediate portion 306 of transparent member 300. In contrast, first end portion 302 and second end portion 304 of transparent member 300 may be visible on lateral portion 134 and medial portion 136, respectively, of midsole 120, since outsole 122 does not extend to lateral portion 134 or medial portion 136 of midsole 120. With this arrangement, protruding portion set 230 may be substantially visible through transparent member 300 on medial portion 136 and lateral portion 134. This configuration may allow article 100 to provide the appearance of an energy return system used in some types of footwear at a substantially reduced cost.

In some embodiments, one or more protruding portions of protruding portion set 230 may be configured to extend to transparent member 300. For example, in one embodiment, second end 244 of first protruding portion 231 may be configured to contact intermediate portion 306 of transparent member 300, as illustrated in FIG. 9. In a similar manner, the ends of second protruding portion 232, third protruding portion 233 and fourth protruding portion 234 may be configured to contact transparent member 300. With this arrangement, protruding portion set 230 may be configured to transmit vertical forces within midsole 120. In other embodiments, however, one or more protruding portions of protruding portion set 230 may be spaced apart from transparent member 300.

An article including a transparent member can include provisions for preventing portions of an outsole from covering the transparent member on a lower portion of the midsole. In some cases, an outsole can be provided with an aperture or hole for viewing the transparent member on the lower portion of the midsole.

FIG. 10 illustrates an alternative embodiment of article 100. Referring to FIG. 10, outsole 122 is provided with aperture 600. Aperture 600 may be configured to extend through the entire depth of outsole 122. In particular, aperture 600 may be configured so that intermediate portion 306 of transparent member 300 may be visible through aperture 600.

In different embodiments, the geometry of aperture 600 can vary. In some cases, aperture 600 can have a square like geometry. In other cases, aperture 600 can have a rectangular geometry. In still other cases, aperture 600 can have a rounded geometry. In still other cases, aperture 600 can have any other type of geometry including regular polygonal geometries, symmetric geometries, irregular geometries and asymmetric geometries. In an exemplary embodiment, aperture 600 can have a substantially rectangular shape.

In different embodiments, the size of aperture 600 can vary. For example, in some cases, the size of aperture 600 can be selected so that aperture 600 has an approximately similar size to intermediate portion 306 of transparent member 300. In other cases, the size of aperture 600 can be selected so that aperture 600 is substantially larger than intermediate portion 306. In still other cases, the size of aperture 600 can be selected so that aperture 600 has a substantially smaller size than intermediate portion 306. In still another embodiment, aperture 600 can have a size that is slightly smaller than intermediate portion 306. In particular, for example, the size of aperture 600 can be selected so that a lowered peripheral ledge is not substantially visible through aperture 600.

Although a single aperture is used in the current embodiment, other embodiments can include two or more apertures. In some cases, multiple apertures can be arranged in a pattern on outsole 122 adjacent to intermediate portion 306 to increase the visibility of intermediate portion 306 through outsole 122. In addition, in some cases, any number of apertures can be applied to other portions of outsole 122 to reveal the lower portion of midsole 120 as well as transparent member 300.

FIGS. 1 through 6 may be generally illustrative of a method of making article of footwear 100. The following discussion includes steps for one method of making article of footwear 100, but it should be understood that in other embodiments different steps may be used. In some cases, one or more of the steps discussed below may be optional. In other cases, additional steps could be provided.

Referring back to FIGS. 1 through 6, during a first step of making article of footwear 100, midsole 120 can be formed with cavity 200 on lower portion 132, lateral portion 134 and medial portion 136. In some embodiments, cavity 200 can be formed on midsole 120 by using a molding technique for forming midsole 120 that is configured to form cavity 200. Furthermore, the molding technique can be configured to form protruding portion set 230 simultaneously with cavity 200. In other embodiments, cavity 200 can be cut from midsole 120 after midsole 120 has been formed. In such embodiments, cavity 200 can be cut out in a manner that leaves protruding portion set 230 formed within cavity 200. In still other embodiments, other techniques known in the art for forming cavities in any portion of a sole structure can be used for forming cavity 200 and protruding portion set 230. It will also be understood that in embodiments not including a protruding portion, the method can include steps for forming a cavity in a midsole without forming any protruding portions.

In some embodiments, lowered peripheral ledge 242 can also be formed on first peripheral portion 240 of cavity 200. In embodiments where midsole 120 is molded, the mold can include features to form lowered peripheral ledge 242. In other embodiments, lowered peripheral ledge 242 can be cut from midsole 120 after midsole 120 has been formed. In still other embodiments, lowered peripheral ledge 242 could be formed in any other manner.

Once midsole 120 has been formed with cavity 200 and including protruding portion set 230, midsole 120 can be associated with transparent member 300. In some embodiments, transparent member 300 can have an initially flat shape. During the step of associating transparent member 300 with cavity 200, transparent member 300 can be bent in a manner so that the geometry of transparent member 300 conforms to the geometry of lower opening 202, lateral opening 204 and medial opening 206 of cavity 200. In particular, first end portion 302 may be bent with respect to intermediate portion 306 to form first bend 320. Likewise, second end portion 304 may be bent with respect to intermediate portion 306 to form second bend 322. With this arrangement, transparent member 300 may be formed into an approximate U shape. In other embodiments, however, transparent member 300 may be pre-formed with a bent geometry.

Next, transparent member 300 may be applied to midsole 120 in a manner that covers cavity 200. In some embodiments, second peripheral portion 310 may be applied to first peripheral portion 240. In particular, second peripheral portion 310 can be disposed against lowered peripheral ledge 242 to provide a substantially flush outer surface 150 for midsole 120. Furthermore, first end portion 302 may be applied in a manner that covers lateral opening 204. Also, second end portion 304 may be applied in a manner that covers medial opening 206. In addition, intermediate portion 306 may be applied in a manner that covers lower opening 202. In an exemplary embodiment, an adhesive can be applied between first peripheral portion 240 and second peripheral portion 310. This arrangement may provide a secure attachment of transparent member 300 to midsole 120.

In some embodiments, outsole 122 can be applied to lower portion 132 after transparent member 300 has been joined with midsole 120. In embodiments where outsole 122 includes an aperture configured to provide a view of intermediate portion 306, the aperture can be aligned with intermediate portion 306. In other embodiments, however, an outsole may not be applied to lower portion 132. Instead, lower portion 132 can be configured as a ground contacting surface for article of footwear 100.

Using this arrangement, an article of footwear can be made that allows an observer to view the interior of a cavity that is disposed internally to a sole structure. Furthermore, in embodiments where the cavity is filled with one or more structures, the structures can be easily viewed on lower, medial and/or lateral portions of the sole structure.

Although the embodiments discussed above illustrate a cavity associated with a lower portion of a midsole, in other embodiments a cavity could be associated with any other portion of a midsole. For example, in another embodiment, a cavity could be associated with an upper portion of a midsole.

Figure 11:
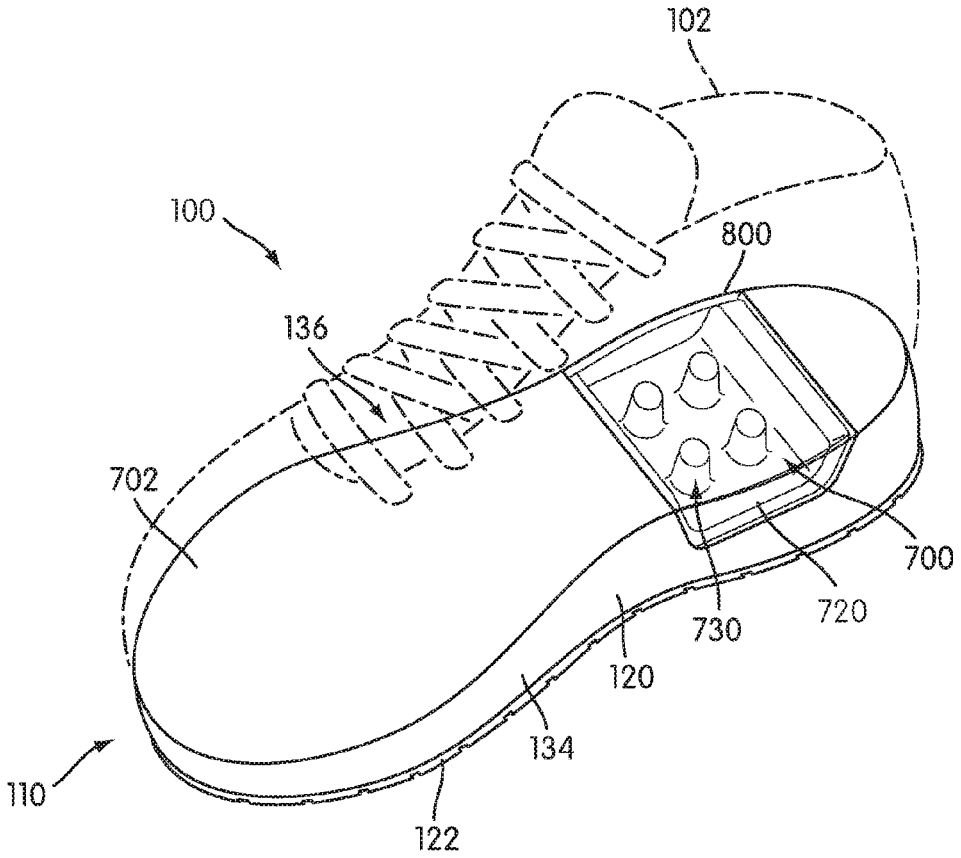
FIG. 11 is an isometric view of an embodiment of an article of footwear.

FIG. 11 illustrates another alternative embodiment of article of footwear 100. Referring to FIG. 11, cavity 700 may be associated with upper portion 702, lateral portion 134 and medial portion 136 of midsole 120. In particular, the geometry of cavity 700 may be substantially similar to the geometry of cavity 200 of the previous embodiments. In contrast to the previous embodiments, however, cavity 700 may be disposed adjacent to upper 102 (shown in phantom), rather than outsole 122.

Cavity 700 can include protruding portion set 730. In some cases, protruding portion set 730 can be substantially similar to protruding portion 230 discussed in the previous embodiment. Furthermore, protruding portion set 730 may be associated with lower surface 720 of cavity 700. In other words, protruding portion set 730 may extend upwards from lower surface 720 towards upper portion 702 of midsole 120.

In addition, article 100 includes transparent member 800 that is configured with a substantially similar shape to the shape of transparent member 300 discussed above. In particular, transparent member 800 is configured with a shape that covers the opening of cavity 700. With this arrangement, cavity 700 is visible on medial portion 136 and lateral portion 134 of midsole 120. However, using this arrangement, cavity 700 may not be visible on upper portion 702 of midsole 120, since upper portion 702 is covered by upper 102.

In addition to providing visibility, transparent member 800 can be configured to provide enhanced cushioning for a foot disposed within upper 102. For example, in some embodiments, transparent member 800 can be disposed below a heel of a foot. During use, as a heel is depressed downwards, transparent member 800 may deflect downwards towards protruding portion set 730. Furthermore, in some cases, protruding portion set 730 can be configured to compress in a manner that provides some cushioning for the heel. Also, in embodiments without protruding portion set 730, transparent member 800 can be configured to provide a restoring force following deflection that also provides enhanced cushioning for the heel.

It will be understood that while the current embodiment includes one or more protruding portions, in other embodiments, a cavity may not include protruding portions. In some cases, a cavity can include other structures that may give the appearance of an energy absorbing system that may be known in the art. Still further, in other embodiments a cavity may not include any interior structures. In other words, in other embodiments, a cavity could be substantially empty. With this arrangement, the cavity may provide the appearance of a hollow air cavity that enhances shock absorption.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. Also, an upper may be made from any suitable material, including, but not limited to: nylon, natural leather, synthetic leather, natural rubber or synthetic rubber.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of forming an article of footwear, the method comprising:

forming a sole structure having a cavity formed in a ground-facing surface and extending from a medial opening at a medial side surface of the sole structure to a lateral opening at a lateral side surface of the sole structure, the cavity including a lowered peripheral ledge extending around the medial opening and the lateral opening; and covering the cavity with a transparent member having a first end and second end extending from opposing ends of an intermediate portion, the first end received by the lowered peripheral ledge extending around the medial opening and being flush with the medial side surface of the sole structure and the second end received by the lowered peripheral ledge of the lateral opening and being flush with the lateral side surface of the sole structure.

2. The method of claim 1, wherein forming a sole structure having a cavity includes defining the cavity by an upper surface recessed from the ground-facing surface and a pair of sidewalls extending between the upper surface and the ground-facing surface.

3. The method of claim 2, further comprising extending the lowered peripheral ledge from the medial opening to the lateral opening along each of the sidewalls, the intermediate portion of the transparent member being received by the lowered peripheral ledge and being flush with the ground-facing surface.

4. The method of claim 2, further comprising forming a protrusion extending from the upper surface of the cavity toward the intermediate portion of the transparent member.

5. The method of claim 4, wherein forming the protrusion includes contacting a distal end of the protrusion with the intermediate portion of the transparent member.

6. The method of claim 4, wherein forming the protrusion includes forming a truncated cone.

7. The method of claim 1, further comprising attaching an outsole to the ground-facing surface of the sole structure.

8. The method of claim 7, further comprising attaching an outsole to the intermediate portion of the transparent member.

9. The method of claim 7, further comprising aligning an aperture of the outsole with the intermediate portion.

10. The method of claim 1, further comprising providing the medial opening and the lateral opening with a trapezoidal shaped.

11. A method of forming a sole structure for an article of footwear, the method comprising:

providing a midsole having a first surface extending from a medial side surface to a lateral side surface and a cavity defined by: (1) a second surface recessed from the first surface and (2) an opposing pair of sidewalls extending from the first surface to the second surface, the cavity intersecting the medial side surface to define a medial opening and intersecting the lateral side surface to define a lateral opening and including a lowered peripheral ledge extending around each of the medial opening and the lateral opening;

providing a transparent member having a first end and a second end extending from opposing ends of an intermediate portion; and covering the cavity of the midsole with the transparent member, the first end being received by the lowered peripheral ledge at the medial opening and being flush with the medial side surface and the second end being received by the lowered peripheral ledge at the lateral opening and being flush with the lateral side surface.

12. The method of claim 11, further comprising extending the lowered peripheral ledge from the medial opening to the lateral opening along each of the sidewalls, the intermediate portion of the transparent member being received by the lowered peripheral ledge and being flush with the first surface.

13. The method of claim 11, further comprising forming a protrusion extending from the second surface of the cavity toward the intermediate portion of the transparent member.

14. The method of claim 13, wherein forming the protrusion includes contacting a distal end of the protrusion with the intermediate portion of the transparent member.

15. The method of claim 13, wherein forming the protrusion includes forming a truncated cone.

16. The method of claim 11, further comprising attaching an outsole to the second surface of the sole structure.

17. The method of claim 16, further comprising attaching an outsole to the intermediate portion of the transparent member.

18. The method of claim 16, further comprising aligning an aperture of the outsole with the intermediate portion.

19. The method of claim 11, further comprising providing the medial opening and the lateral opening with a trapezoidal shaped.

20. The method of claim 11, further comprising providing the transparent member with a U-shape.

* * * * *